US007802736B2

(12) United States Patent
Scobie

(10) Patent No.: US 7,802,736 B2
(45) Date of Patent: Sep. 28, 2010

(54) RAILWAY GROUND CROSSTIE

(75) Inventor: Michael A. N. Scobie, Temiscaming (CA)

(73) Assignee: Tembec Industries Inc., Montreal, Quebec (CA)

( * ) Notice: Subject to any disclaimer, the term of this patent is extended or adjusted under 35 U.S.C. 154(b) by 398 days.

(21) Appl. No.: 11/816,429

(22) PCT Filed: Mar. 10, 2006

(86) PCT No.: PCT/CA2006/000343

§ 371 (c)(1),
(2), (4) Date: Aug. 16, 2007

(87) PCT Pub. No.: WO2006/099715

PCT Pub. Date: Sep. 28, 2006

(65) Prior Publication Data

US 2008/0142611 A1 Jun. 19, 2008

(30) Foreign Application Priority Data

Mar. 23, 2005 (CA) ..... 2499193

(51) Int. Cl.
*E01B 9/14* (2006.01)

(52) U.S. Cl. ..... 238/84

(58) Field of Classification Search ..... 238/29, 238/30, 82–84, 95–103
See application file for complete search history.

(56) References Cited

U.S. PATENT DOCUMENTS

| | | | | |
|---|---|---|---|---|
| 445,063 | A * | 1/1891 | Kubach | 238/32 |
| 567,632 | A | 9/1896 | Adams | |
| 730,059 | A | 6/1903 | Van Tassel | |
| 1,195,302 | A * | 8/1916 | Walker | 238/100 |
| 1,389,069 | A | 8/1921 | Paff | |
| 2,004,369 | A | 11/1935 | Etheridge | |
| 5,104,039 | A | 4/1992 | Oestmann | |
| 6,230,981 | B1 | 5/2001 | Hill | |
| 6,247,651 | B1 | 6/2001 | Marinelli | |
| 6,766,963 | B2 | 7/2004 | Hansen | |
| 2003/0085293 | A1 | 5/2003 | Nosker | |

FOREIGN PATENT DOCUMENTS

| | | | |
|---|---|---|---|
| CA | 227636 | A1 | 1/1923 |
| CA | 1053205 | A1 | 4/1979 |
| DE | 4111088 | A1 | 10/1991 |
| JP | 6272202 | A2 | 9/1994 |

* cited by examiner

*Primary Examiner*—S. Joseph Morano
*Assistant Examiner*—Robert J McCarry, Jr.
(74) *Attorney, Agent, or Firm*—Jeffrey S. Melcher; Manelli Denison & Selter PLLC

(57) ABSTRACT

An elongate railway crosstie for supporting rail tracks on a bed of stones or the like, said tie having a first end, a second end, a length between said first and second ends and a top surface, a bottom surface and a pair of side surfaces between said first and second ends, characterized in that at least one of said side surfaces has a portion of a non-planar stone-embeddable form extending between said first and second ends, so-shaped as to effect reduced lateral and longitudinal slippage of said tie within said bed, while providing a reduction in the volume of material used.

11 Claims, 3 Drawing Sheets

RAILWAY GROUND CROSSTIE

This application is a national phase entry filed under 35 U.S.C. 371 of PCT/CA2006/000343, filed 10 Mar. 2006. This application further claims foreign priority under 35 U.S.C. 119 and 365 from Canadian application No. 2,499,193, filed 23 Mar. 2005.

FIELD OF THE INVENTION

This invention relates to an improved railway ground tie having satisfactory performance requirements of the railway industry, while minimizing the amount of material needed; and particularly said tie formed of a lignocellulose fibre-resin composite material.

BACKGROUND TO THE INVENTION

Today, in North America and around the world, the vast majority of railway crossties used are made of rectangular pieces of creosote-impregnated hardwood or softwood. Typical dimensions for these ties are about 2.4-2.6 m in length, about 18-23 cm in width, and about 15-18 cm in height. Even ties made from newer materials, such as concrete, steel, plastic or composites in general, mimic this standard rectangular design.

One of the key railway safety and performance issues is lateral track stability i.e. sideways movement of the ties perpendicular to the parallel rails, particularly, the ability of the entire track to resist lateral movement when subjected to forces produced by the movement of trains. Lateral track movement is costly because it requires expensive maintenance to reposition the track and, if left to exceed established limits, the lateral travel movement can cause track failure and, ultimately, train derailments.

Typically when installed, the ties are partially buried in rock particles known as ballast. The crosstie/ballast relationship is one of the main defenses against lateral track movement. The better the tie is "locked" into the ballast, the more the track will resist lateral movement. The rail industry relies on friction between the ballast and wooden ties to resist movement. This friction increases over time due to the formation of pits or pockets in the ties caused by abrasion from the rock particles. Unfortunately, in situations where significant lengths of track have been replaced, this "conditioning phase" can force the track user to temporarily slow train movements, which in turn can cause operational complexity and loss of efficiency. This is one of the reasons that steel ties have not found wide spread acceptance. Their friction factor is very low and, consequently, they are susceptible to longitudinal movement, i.e. movement parallel to the railway lines. Extruded HDPE (high-density polyethylene) tie producers have tried to deal with HDPE's natural "slipperiness" by embossing or pitting the side surfaces, while respecting the original tie dimensions.

U.S. Pat. No. 4,285,115, issued Aug. 25, 1981 to Arbed, describes a steel or concrete sleeper having improved directional stability and sliding resistance due to the sleeper being formed in a Y-shape. Each arm of the Y-shape is of identical and consistent cross-section.

U.S. Pat. No. 6,230,981 B1—issued May 15, 2001 to Corus U.K. Limited describes a steel railroad sleeper (tie) of inverted channel section that may have a waisted central section of reduced width. U.S. Pat. No. 6,230,981 B1 focuses exclusively on producing a hollow sleeper from cold rolled steel. The purpose of the reduced central cross-section is to create greater locking of ballast that must be propelled into the sleeper interior and to reduce the amount of ballast necessary to fill the sleeper interior. The central region can also be filled with foam that would actually prevent ballast from entering this region. It is not clear whether the waisted central section is for locking the sleeper into position or to increase friction between the tie and the ballast.

United States Patent Application No. 2003/0085293 A1, published May 8, 2003 to Nosker et al, describes a crosstie surface design consisting of a pattern of indentations that contacts the ballast, which increases the ties' resistance to sliding (abstract). It is an alternative pattern to previous attempts at surface scoring (paragraph 0020). It considers molding or embossing the pattern into the tie so as not to compromise the said ties' overall rectangular cross-sectional dimensions (paragraph 0024).

However, none of the aforesaid prior art references provides ties having sufficiently improved efficacy in preventing lateral tie slippage and longitudinal track movement with reduced tie volume and, thus, material costs.

There is, therefore, a need for an improved tie that decreases the lateral movement of the tie within the ballast, while at the same time minimize the volume of the tie and, thus, the amount of material required.

SUMMARY OF THE INVENTION

It is an object of the present invention to provide a railway ground crosstie that works in conjunction with stone ballast to maximize friction between the tie and ballast, immediately, from the time of installation.

It is a further object of the present invention to provide a crosstie that sufficiently minimizes the effective crosstie volume.

Accordingly, the invention provides in one aspect an elongate railway crosstie for supporting rail tracks on a bed of stones or the like, said tie having a first end, a second end, a length between said first and said second ends and a top surface, a bottom surface and a pair of side surfaces between said first and second ends, characterized in that at least one of said side surfaces has a portion of a non-planar stone-embeddable form extending between said first and said second ends, so-shaped as to effect reduced lateral and longitudinal slippage of said tie within said bed.

Preferably, the crosstie, is as defined hereinabove wherein at least one of said side surfaces has a portion of undulating form extending between said first and second ends, wherein said undulating portion is so-shaped as to define a plurality of concave and convex surfaces which are embeddable in said bed of stone to effect reduced lateral and longitudinal slippage of said tie within said bed.

More preferably, the invention provides a crosstie wherein said undulating portion extends the full length between said first and second ends of said tie.

More preferably, the invention provides a crosstie wherein both of said side surfaces have an undulating form.

In preferred embodiments, the tie as hereinabove defined, has a first end portion adjacent and extending a first distance from said first end and a second end portion adjacent and extending a second distance from said second end wherein (i) said side surfaces of said first end portion are parallel the length of said first distance, (ii) said side surfaces of said second end portion are parallel the length of said second portion; and (iii) said first end portion and said second portion define therebetween an inner portion.

In further preferred embodiments, the inner portion has a plurality of central portions defining a plurality of different inner widths.

In further preferred embodiments, the inner portion has a plurality of portions of widths inwardly decreasing from said first end portion and said second end portion.

The inner portion is further, preferably, spline-shaped and tapered inwardly from said first end portion and said second end portion.

In further preferred embodiments the invention provides a railway crosstie for supporting rail tracks on a bed of stones or the like, said tie having a first end;

a second end;

a top surface, a bottom surface and a pair of side surfaces between said first and said second ends;

characterized in that said tie has a first end portion adjacent and extending a first distance from said first end and having a first end portion width;

a second end portion adjacent and extending a second distance from said second end and having a second end portion width;

wherein (i) said side surfaces of said first end portion are parallel the length of said first distance;

(ii) said side surfaces of said second end portion are parallel the length of said second distance; and (iii) said first end portion is separated from said second portion by an inner portion;

wherein said inner portion has (a) a midpoint equidistant from said first portion and said second portion and of smaller width than said first and second end portions;

(b) side surfaces of undulating form as to define a plurality of concave and convex surfaces;

(c) a pair of tapered portions constituted by a plurality of portions having widths decreasing inwardly from said first end portion and said second end portion to said midpoint;

wherein said plurality and undulation of said concave and convex surfaces embeddable in said bed of stones is such as to effect reduced lateral and longitudinal slippage of said tie within said bed.

Most preferably, a tie as hereinabove defined has (i) a length between said first end and said second end selected from about 2.4-2.6 m;

(ii) a height selected from about 15-18 cm;

(iii) a first end portion width and a second end portion width selected from about 18-23 cm;

a first end portion and said second end portion length selected from about 40-50 cm;

(iv) a midpoint width selected from about 8-12 cm; and (v) each of said tapered portions has an undulating inter-crest distance selected from 15-30 cm.

The tie may be formed, for example, of a material selected from wood, concrete, steel, a plastics material and a composite material.

The composite material is preferably a lignocellulose-resin material, most preferably, wherein said resin is a phenol-formaldehyde.

The aforesaid lignocellulose-resin composite is most preferably made by the method as described in PCT/CA2004/001679—Tembec Industries, Inc., published March 2005, comprising (a) providing an aqueous lignocellulose fiber pulp slurry having an effective consistency;

(b) de-watering said slurry comprising applying multi-dimensional compression to said slurry to provide a de-watered material at an effective de-watering rate under an effective pressure to prevent or reduce the formation of fissures and voids within said material; and (c) drying an effective amount of said de-watered material at an effective temperature and period of time to provide said formed, dried lignocellulose fiber material of a shape having a thickness of at least 5 mm.

In a further aspect, the invention provides a railway track comprising in combination a railway tie as hereinabove defined in any one of claims 1 to 15, and a pair of railway tracks on a bed of stones, wherein said ties are embedded in said bed of stones.

BRIEF DESCRIPTION OF THE DRAWINGS

In order that the invention may be better understood, preferred embodiments will now be described, by way of example only, with reference to the accompanying drawings, wherein.

DETAILED DESCRIPTION OF PREFERRED EMBODIMENTS

Figure 1:
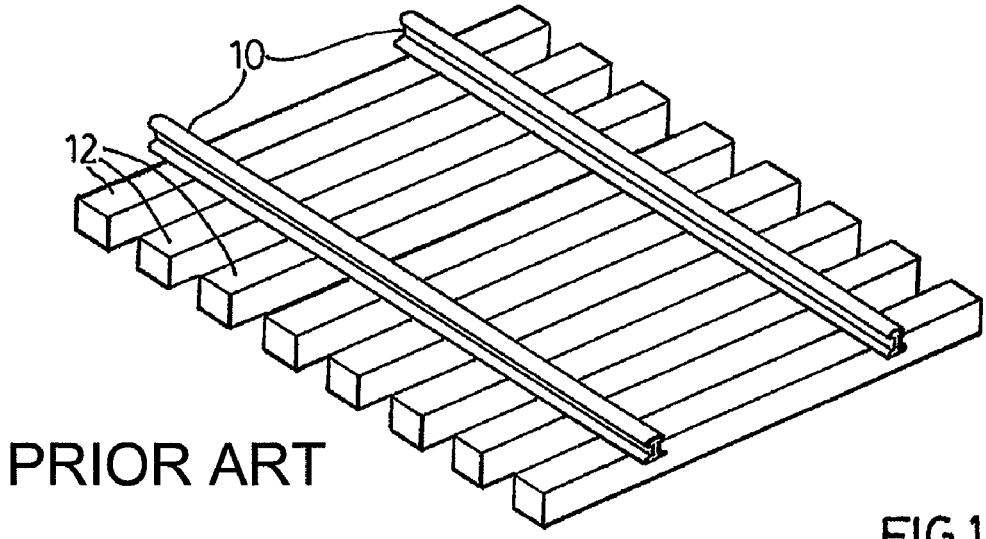
FIG. 1 is a perspective view of a railway track with wood railway crossties according to the prior art.
Figure 3:
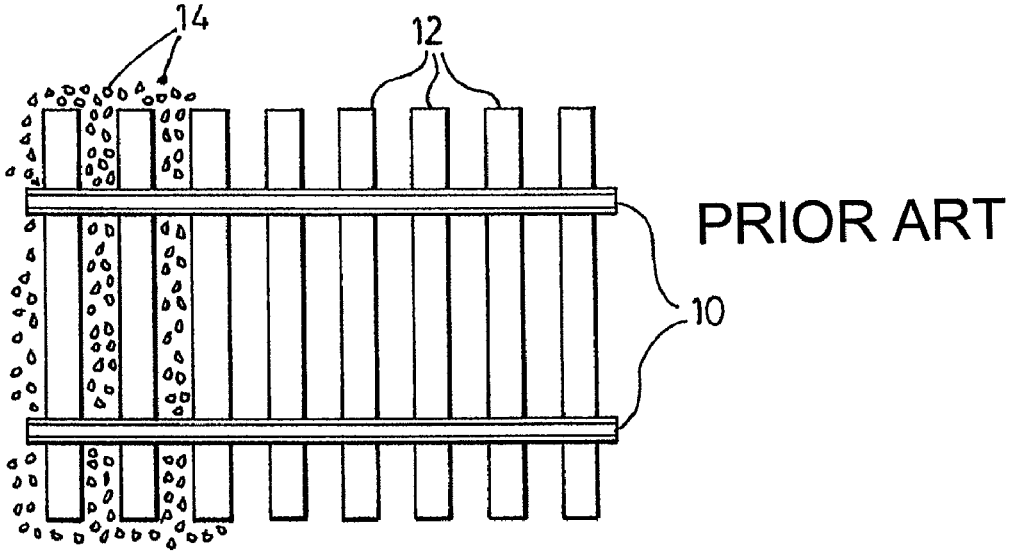
FIG. 3 is a diagrammatic plan view of the track according to FIG. 1.

With reference to FIGS. 1 and 3, these show steel tracks 10 perpendicularly affixed to a plurality of parallel wooden crossties 12 according to the prior art, embedded in a stone ballast bed 14.

Figure 2:
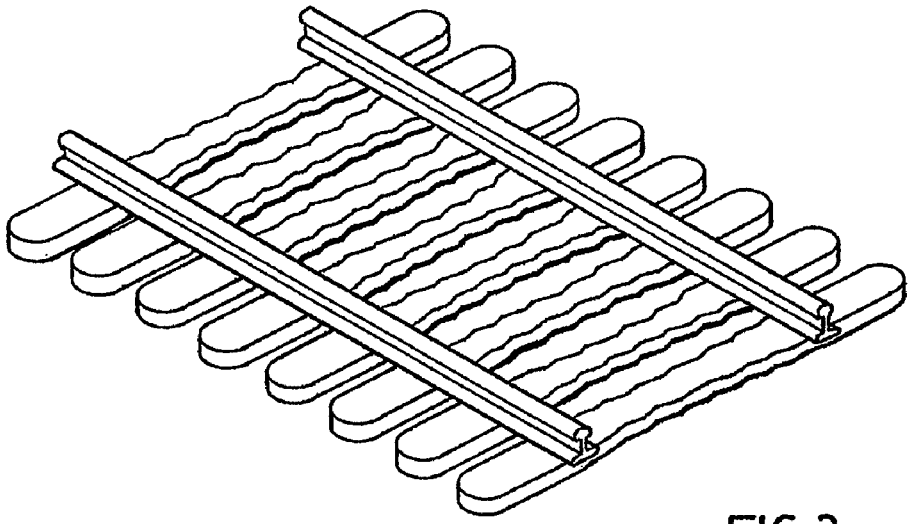
FIG. 2 is a perspective view of a railway track with crossties according to the invention.
Figure 4:
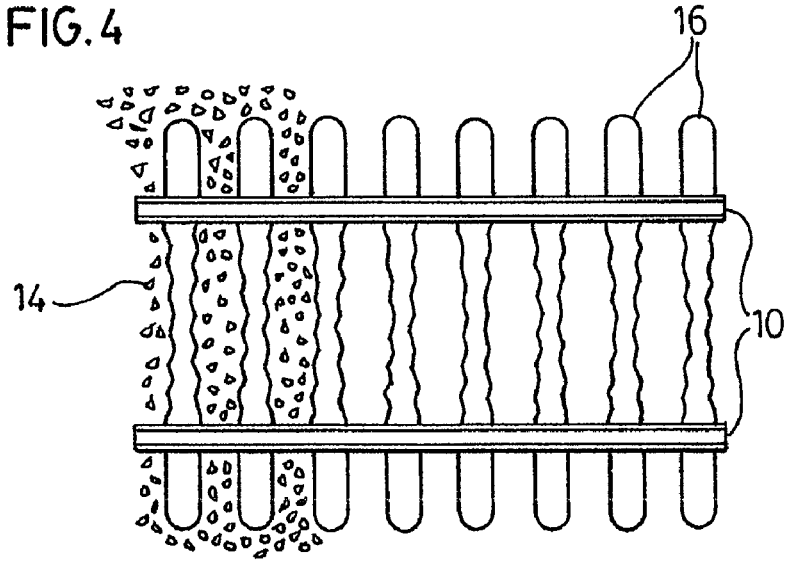
FIG. 4 is a diagrammatic plan view of the track according to FIG. 2.
Figure 5:
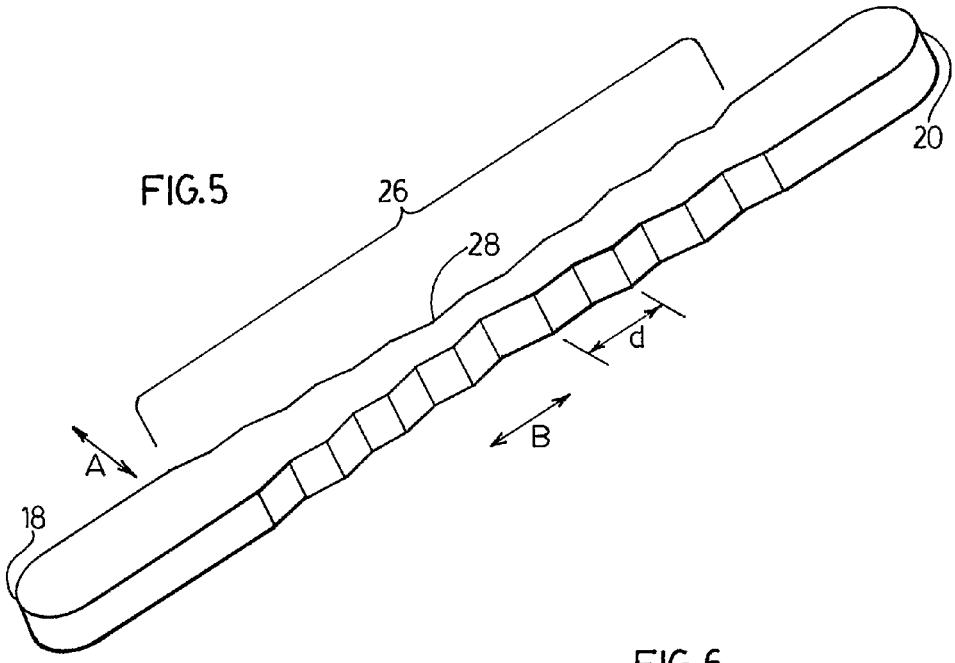
FIG. 5 is a perspective view of a crosstie according to the invention.
Figure 6:
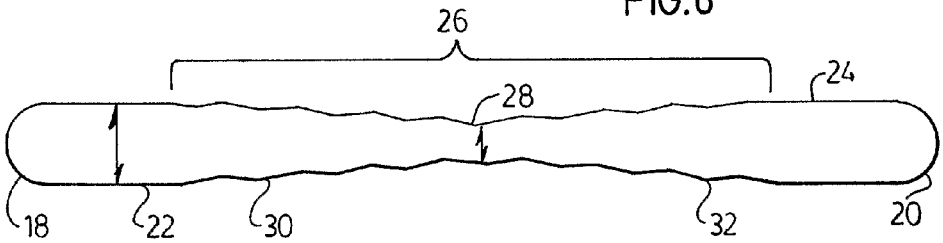
FIG. 6 is a diagrammatic plan view of a crosstie according to the invention.
Figure 7:
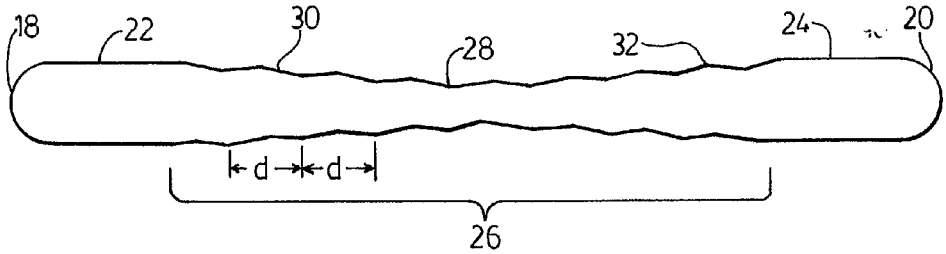
FIG. 7 is a diagrammatic plan view of the crosstie of FIG. 6.
Figure 8:
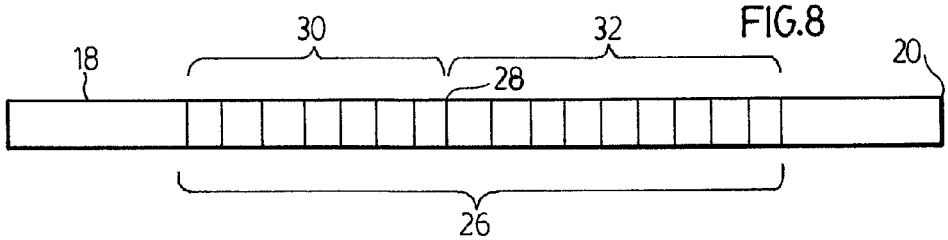
FIG. 8 is a diagrammatic side longitudinal view of the crosstie of FIG. 6; and wherein the same numerals denote like parts.

FIG. 2 and FIG. 4 show steel rails 10 affixed to a plurality of lignocellulose-resin (phenol formaldehyde) composite material crossties 16, according to the invention, embedded within stone ballast 14.

With reference also to FIGS. 5-8, a crosstie 16 has a length of about 2.6 m between first end 18 and a second end 20, a constant height of about 12.8 cm along its length, and a width of about 23 cm at end portions 22,24 adjacent its ends 18 and 20, respectively. Actual ends 18 and 20 are gently rounded. End portions 22,24 extend longitudinally for about 45 cm from ends 18 and 20, respectively, to define, therebetween, an inner portion 26 of approximately 1.68 m having a central portion 28 midway of tie 16.

Portion 26 has an undulating form so shaped as to define a plurality of concave and convex surfaces which when embedded in stone ballast 14 reduce the longitudinal and lateral slippage of tie 16 as denoted by arrows "A" and "B", respectively. In the embodiments shown, portion 26 is, thus, spline-shaped while being tapered inwardly from each end portion 22,24 to central portion 28, to constitute a pair of tapered portions 30,32, and define a plurality of portions of different widths, which in this embodiment said widths decrease inwardly from each end portion 22,24.

Generally, each of tapered portions 30,32 has an undulating intercrest distance "d" selected from 15-30 cm, and approximately 25 cm in the embodiment shown. The tapered portions 30,32 gradually decrease in width from the width "$w_1$" (FIG. 6) of 23 cm of end portions 22,24 to that of 10 cm at midpoint 28.

The tie 16 may be made by a process as described in aforesaid PCT/CA2004/001679.

Although this disclosure has described and illustrated certain preferred embodiments of the invention, it is to be understood that the invention is not restricted to those particular embodiments. Rather, the invention includes all embodiments which are functional or mechanical equivalence of the specific embodiments and features that have been described and illustrated.

The invention claimed is:

1. An elongate, solid, unitary railway crosstie for supporting rail tracks on a bed of stones, said tie having a first end, a second end, an inner portion between said first and second ends and a top surface, a bottom surface and a pair of side surfaces between said first and second ends, wherein at least one of said side surfaces has a portion of undulating portion so-shaped as to define a plurality of concave and convex surfaces which are embeddable in said bed of stones to effect reduced lateral and longitudinal slippage of said tie within said bed; and said tie has a first end portion adjacent and extending a first distance from said first end and a second end portion adjacent and extending a second distance from said second end wherein said first end portion and said second end portion define therebetween an inner portion, wherein said inner portion has a plurality of central portions defining a plurality of different inner widths narrower than the width of said first and said second end portions and a plurality of portions of widths inwardly decreasing from said first end portion and said second end portion, and wherein the crosstie is formed from a lignocellulose-resin material.

2. A tie as claimed in claim 1 wherein both side surfaces have an undulating form.

3. A tie as claimed in claim 1 wherein said undulating portion extends the full length between said first and second ends of said tie.

4. A tie as claimed in claim 1 wherein said side surfaces of said first end portion are parallel the length of said first distance and said side surfaces of said second end portion are parallel the length of said second distance.

5. A tie as defined in claim 1 wherein said inner portion is spline-shaped and tapered inwardly from said first end portion and said second end portion.

6. A tie as defined in claim 1 wherein said resin is a phenol-formaldehyde.

7. A railway track comprising a combination railway tie as defined in claim 1, and a pair of railway tracks on a bed of stones, wherein said ties are embedded in said bed of stones.

8. A solid, unitary railway crosstie for supporting rail tracks on a bed of stones, said tie having:

a first end;

a second end; and a top surface, a bottom surface and a pair of side surfaces between said first and said second ends;

wherein said tie has a first end portion adjacent and extending a first distance from said first end and having a first end portion width;

a second end portion adjacent and extending a second distance from said second end and having a second end portion width;

wherein (i) said side surfaces of said first end portion are parallel the length of said first distance;

(ii) said side surfaces of said second end portion are parallel the length of said second distance; and (iii) said first end portion is separated from said second portion by an inner portion;

wherein said inner portion has (a) a midpoint equidistant from said first portion and said second portion and of smaller width than said first and second end portions;

(b) side surfaces of undulating form as to define a plurality of concave and convex surfaces; and (c) a pair of tapered portions constituted by a plurality of portions having widths decreasing inwardly from said first end portion and said second end portion to said midpoint; and wherein said plurality and undulation of said concave and convex surfaces when embedded in said bed of stones effect reduced lateral and longitudinal slippage of said tie within said bed.

9. A tie as defined in claim 8 wherein said tie has (i) a length between said first end and said second end selected from about 2.4-2.6 m;

(ii) a height selected from about 15-18 cm;

(iii) said first end portion width and said second end portion width selected from about 18 to 23 cm;

(iv) said first end portion and said second end portion length selected from about 40 to 50 cm;

(v) said midpoint width selected from about 8-12 cm; and (v) each of said tapered portions has an undulating intercrest distance selected from 15-30 cm.

10. A railway track comprising a combination railway tie as defined in claim 8, and a pair of railway tracks on a bed of stones, wherein said ties are embedded in said bed of stones.

11. A method of making an elongate, solid, unitary railway crosstie for supporting rail tracks on a bed of stones, said tie having a first end, a second end, an inner portion between said first and second ends and a top surface, a bottom surface and a pair of side surfaces between said first and second ends, wherein at least one of said side surfaces has a portion of undulating portion so-shaped as to define a plurality of concave and convex surfaces which are embeddable in said bed of stones to effect reduced lateral and longitudinal slippage of said tie within said bed; and said tie has a first end portion adjacent and extending a first distance from said first end and a second end portion adjacent and extending a second distance from said second end wherein said first end portion and said second end portion define therebetween an inner portion, wherein said inner portion has a plurality of central portions defining a plurality of different inner widths narrower than the width of said first and said second end portions and a plurality of portions of widths inwardly decreasing from said first end portion and said second end portion, wherein the crosstie is formed of a composite material, the method comprising (a) providing an aqueous lignocellulose fiber pulp slurry having an effective consistency;

(b) de-watering said slurry comprising applying multi-dimensional compression to said slurry to provide a de-watered material at an effective de-watering rate under an effective pressure to prevent or reduce the formation of fissures and voids within said material; and (c) drying an effective amount of said de-watered material at an effective temperature and period of time to provide a formed, dried lignocellulose fiber material of a crosstie shape having a thickness of at least 5 mm.

* * * * *